US006904629B2

(12) United States Patent
Wu

(10) Patent No.: US 6,904,629 B2
(45) Date of Patent: Jun. 14, 2005

(54) BED WITH FUNCTION OF VENTILATION

(76) Inventor: Wan-Ching Wu, 235 Chung-Ho Box 8-24, Taipei (TW)

( * ) Notice: Subject to any disclaimer, the term of this patent is extended or adjusted under 35 U.S.C. 154(b) by 156 days.

(21) Appl. No.: 10/265,463

(22) Filed: Oct. 7, 2002

(65) Prior Publication Data

US 2004/0064888 A1 Apr. 8, 2004

(51) Int. Cl.[7] ..... A47C 21/04
(52) U.S. Cl. ..... 5/423; 5/726
(58) Field of Search ..... 5/423, 726

(56) References Cited

U.S. PATENT DOCUMENTS 3,266,064 A * 8/1966 Figman ..... 5/423
3,928,876 A * 12/1975 Starr ..... 5/726
5,645,314 A * 7/1997 Liou ..... 5/423
6,336,237 B1 * 1/2002 Schmid ..... 5/423

* cited by examiner

*Primary Examiner*—Alexander Grosz

(57) ABSTRACT

A bed with a bed cushion has a bed cushion surface integrally formed by emulsion. The surface of the emulsion bed cushion surface having a plurality of wind trenches. Each wind trench has a plurality of vents for venting air. The bed cushion surface being elastic; one lateral side of the bed cushion having a through hole. A periphery of the through hole being enclosed by is a soft protrusion. A head portion of a bed is formed with an enclosing trench with a configuration with respect to the protrusion. A via hole is formed in the enclosing trench. A fan is installed within the hole. The enclosing trench is tightly engaged to the protrusion so that the wind out of the fan flows into the bed cushion from the through hole. Then the wind is vented out of the bed cushion surface from the vents.

2 Claims, 3 Drawing Sheets

BED WITH FUNCTION OF VENTILATION

FIELD OF THE INVENTION

The present invention relates to bed structures, and particularly to a bed with function of ventilation.

BACKGROUND OF THE INVENTION

Referring to FIG. 1, a bed disclosed in Japan Laid-Open No. 6820-3B is illustrated. In this prior art, a soft pad 31 is installed between the springs 20 of the bed cushion 10. The upper and lower sides of the spring 20 are installed with an upper soft pad 32 and a lower soft pad 33, respectively. The spring 20 has an upper ring 21 and a lower ring 22. The upper ring 21 and lower ring 22 clamp the pad 31 so that adjacent springs 20 are spaced by a pad 31. The upper pad 32 and lower pad 33 are installed to clamp the upper and lower surfaces of the spring 20. An elastic pad 40 is installed on the upper pad 32. The elastic pad 40 is formed by a plurality of small pads 41. In assembly the elastic pad 40, two sheets of pads 32 are enclosed by two pieces of cloths 42 at two sides and the cloths are seamed to form a plurality of small pads 41, as shown in FIG. 1.

By above mentioned components, when the bed cushion 10 is pressed, since gravitation force is buffered by soft pad 31, the pressure applied upon the spring is reduced. By the soft pad 31 between the springs 20, the springs 20 are isolated effectively so that when a force is applied to the spring, it will not be pulled away. Thus the bed will not collapse.

Although this prior art has improved some defects in prior art designs by using the pad structure, the interactions between the springs 20 are still strong. Thereby, the actions of one user lying on the bed will greatly affect another people lying aside the user.

Therefore, there is an eager demand for a novel design which can improve the defects in the prior art, in that the response in one action will not affect other sections far away from the section with a force applied thereon.

SUMMARY OF THE INVENTION

Accordingly, the primary object of the present invention is to provide a bed with a bed cushion having a bed cushion surface integrally formed by emulsion. The emulsion bed cushion surface has a plurality of wind trenches. Each wind trench has a plurality of vents for venting air. By the wind trenches, the bed cushion surface is divided into a plurality of small bed cushion surfaces. Thus, the bed cushion surface is elastic. One lateral side of the bed cushion has a through hole. A periphery of the through hole is a soft protrusion. A head portion of a bed is formed with an enclosing trench with a configuration with respect to the protrusion. A via hole is formed in the enclosing trench. A fan is installed within the hole. The enclosing trench is tightly engaged to the protrusion so that the wind out of the fan flows into the bed cushion from the through hole. Then the wind is vented out of the bed cushion surface from the vents.

The various objects and advantages of the present invention will be more readily understood from the following detailed description when read in conjunction with the appended drawing.

DETAILED DESCRIPTION OF THE PREFERRED EMBODIMENTS

Figure 1:
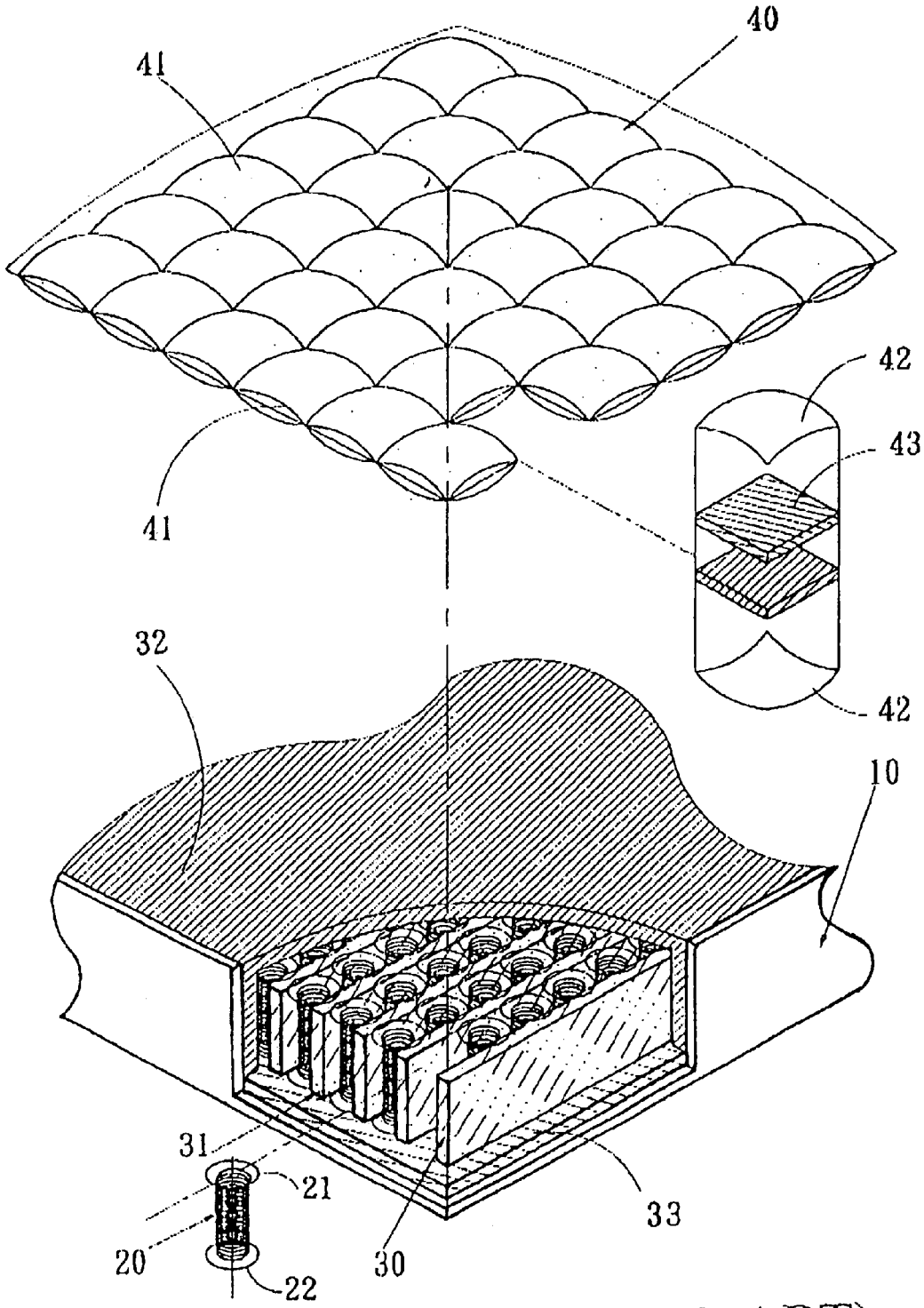
FIG.1 (PRIOR ART)
FIG. 1 shows an exploded view of a prior art bed cushion.
Figure 2:
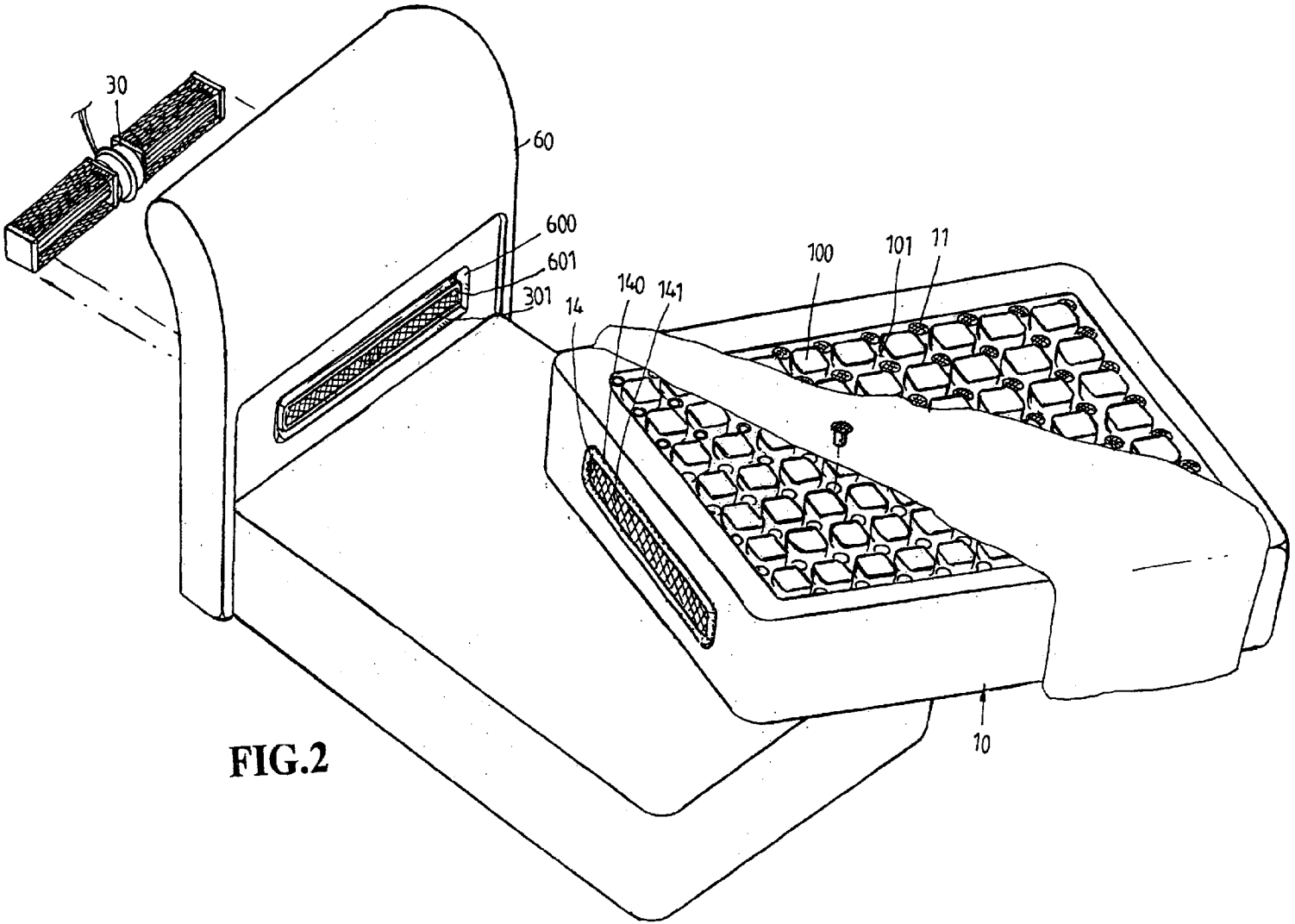
FIG. 2 is an exploded perspective view of the present invention.
Figure 3:
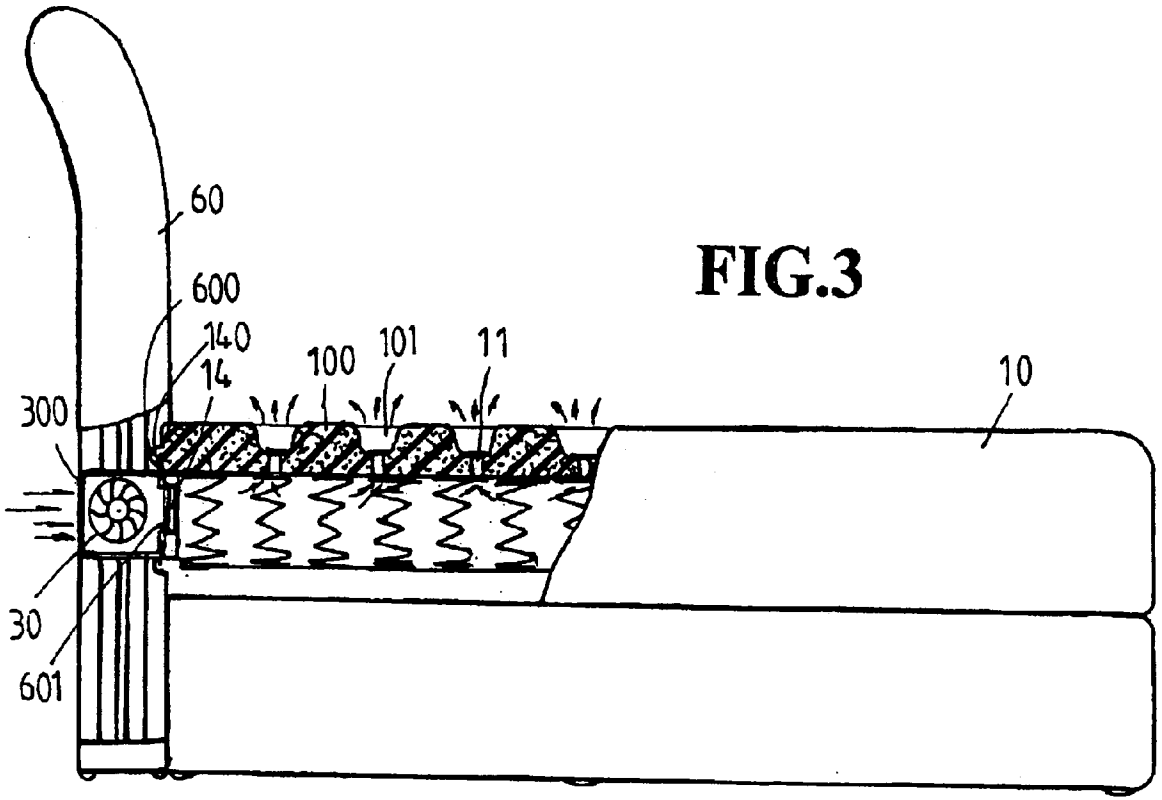
FIG. 3 is an assembled cross sectional view of the present invention.

Referring to FIGS. 2 and 3, the exploded perspective view and the assembled cross sectional view of the present invention are illustrated. The present invention relates to a bed cushion surface 100 integrally formed by emulsion for replacing the conventional bed cushion surface made of conventional coconut fiber.

A surface of the emulsion bed cushion surface has a plurality of wind trenches 101. These wind trenches 101 can be arranged alternatively or non-alternatively. Each wind trench 101 has a plurality of vents 11 for venting. Moreover, by the wind trenches 101, the bed cushion surface 100 is divided into a plurality of small bed cushion surfaces. Thus, the bed cushion surface 100 is elastic. Thereby, actions of one user lying on the bed will not affect the action of another user also lying on the bed.

One lateral side of the bed cushion 10 has a through hole 14. A periphery of the through hole 14 is enclosed by a soft protrusion 140. The head portion 60 of the bed is formed with an enclosing trench 600 with a configuration with respect to the soft protrusion 140. A via hole cavity 601 formed in the enclosing trench 600. A fan 30 is installed within the hole 601. The enclosing trench 600 can be tightly engaged to the protrusion 140 so that the wind out of the fan 30 flows into the bed cushion 10 from the through cavity 14. Then the wind is vented out of the bed cushion surface 100 from the vents 11, but in the prior art, the fan 30 is installed to the lateral surface of the bed cushion 10 or a connecting mask is used to connect the fan 30.

In above structure, the front and rear sides of the fan 30 and the vents of the lateral sides of the bed cushion 10 can be formed with safety nets 300, 301, and 141 so as to increase the safety of the device.

Thereby, from above structure, it is known that the present invention has the following advantages:

(3) By the wind trenches 101, the bed cushion 10 has a preferred ventilating effect. Moreover, by the vents, the bed cushion surface 100 is divided into a plurality of small bed cushion surfaces. Thus, the bed cushion surface 100 is elastic. Thereby, actions of one user lying on the bed will not affect the action of another user also lying on the bed.

(4) The bed cushion 10 has a through hole 14. A periphery of the bed cushion is a soft protrusion 140. The head portion 60 of the bed is formed with an enclosing trench 600 with a configuration with respect to the protrusion 140. A via hole 601 is formed in the enclosing trench 600. A fan is installed within the hole 601. The enclosing trench 600 can be tightly engaged to the protrusion 140 so that the wind out of the fan 30 flows into the bed cushion 10 from the through hole 14. Thereby, the bed cushion 10 is comfortable and cool. Moreover, the bed cushion 10 has a beautiful look.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A bed having functions of ventilation; the bed comprising a bed cushion; the bed cushion including a bed cushion surface; the bed cushion surface having a plurality of wind trenches; each wind trench having a plurality of vents for venting air in the bed cushion; by the wind trenches, the bed cushion surface being spaced into a plurality of small bed cushion surfaces; thus, the bed cushion surface being elastic;

a through hole in one lateral side of the bed cushion; a periphery of the through hole including a soft protrusion;

a head portion including an enclosing trench including a cavity having a fan installed within it;

wherein in assembly, the enclosing trench is tightly engaged to the soft protrusion so that the wind out of the fan flows into the bed cushion from the cavity; then the wind is vented out of the bed cushion surface from the vents of the wind trenches.

2. The bed of claim 1, wherein a front and a rear sides of the fan, and the vents of the bed cushion are formed with safety nets.

* * * * *